US008635778B1

(12) United States Patent
Hagaman

(10) Patent No.: US 8,635,778 B1
(45) Date of Patent: Jan. 28, 2014

(54) PANEL PRODUCTION MECHANISMS

(76) Inventor: Harry E. Hagaman, Santa Rosa, CA (US)

( * ) Notice: Subject to any disclaimer, the term of this patent is extended or adjusted under 35 U.S.C. 154(b) by 1163 days.

(21) Appl. No.: 12/287,638

(22) Filed: Oct. 11, 2008

Related U.S. Application Data

(60) Provisional application No. 60/998,673, filed on Oct. 11, 2007.

(51) Int. Cl.
*B21D 47/00* (2006.01)

(52) U.S. Cl.
USPC ..... 29/897.32

(58) Field of Classification Search
USPC ..... 29/897.32; 52/745.19
See application file for complete search history.

(56) References Cited

U.S. PATENT DOCUMENTS 7,073,306 B1 7/2006 Hagaman
2009/0100778 A1 * 4/2009 Ruid et al. ..... 52/506.01

* cited by examiner

*Primary Examiner* — David Bryant
*Assistant Examiner* — Moshe Wilensky

(57) ABSTRACT

This is an improved method of manufacturing building panels and wall sections so that the manufacture of these panels and walls will be more efficient and economical. The building panels and walls have an inner insulator core and two substantially parallel surface materials which are connected together by connector ties. The panels and walls are described in an earlier invention by the present inventor in U.S. Pat. No. 7,073,306 by Hagaman (2006). Included in the present invention are mechanisms and manufacturing machines which produce building panels in a continuous manner. This continuous manufacturing machinery is economical to build, economical to use, and energy efficient in its operation. Other improvements of the present invention are the manufacturing ability to readily make building panels of different thicknesses, widths and heights, quickly insert and attach connecting ties, and improve quality of the building panels.

20 Claims, 15 Drawing Sheets

FRONT VIEW

SIDE VIEW

FIG. 15 a,b,c,d
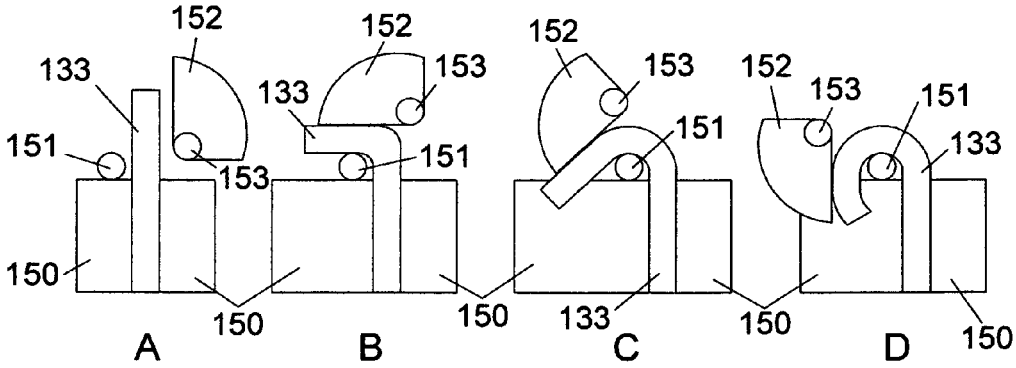
FIG. 16 a,b,c
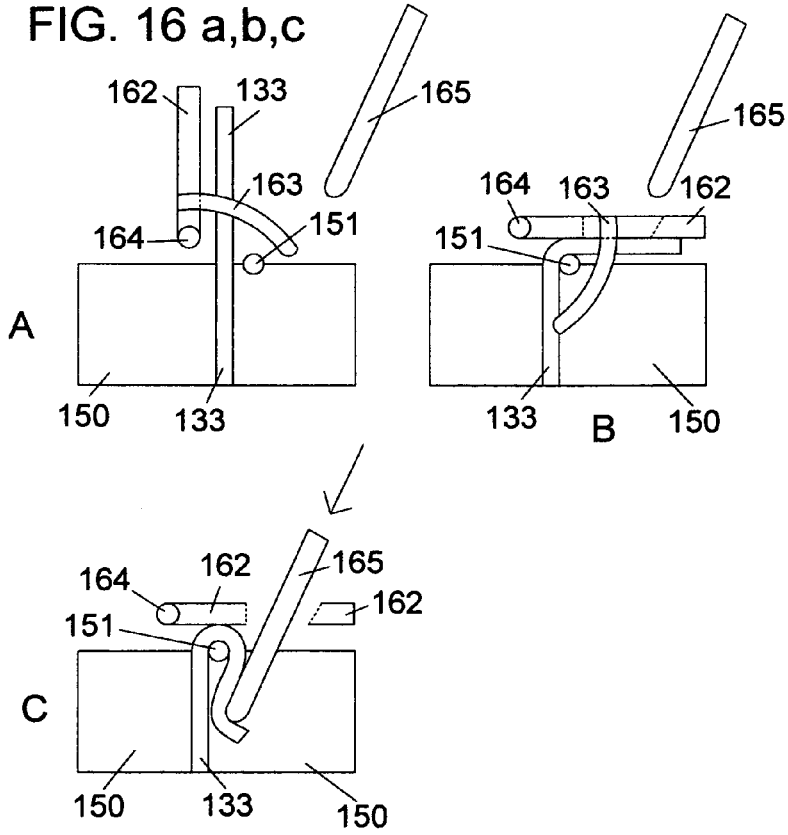

PANEL PRODUCTION MECHANISMS

CROSS-REFERENCE TO RELATED APPLICATIONS

The present application is related to application Ser. No. 10/799,219, Filed Mar. 12, 2004 by the present inventor, now U.S. Pat. No. 7,073,306, granted Jul. 11, 2006. The present application claims the benefit of Provisional Patent Application Ser. No. 60/998,673, filed 2007 Oct. 11 by the present inventor.

FEDERALLY SPONSORED RESEARCH

Not Applicable

SEQUENCE LISTING OR PROGRAM

Not Applicable

BACKGROUND OF THE INVENTION

1. Field of the Invention

This invention relates generally to improvement of the manufacturing of building panels used in the construction of buildings and other static structures.

2. Background of the Invention

The present invention relates to mechanisms and methods of manufacturing building panels and wall sections. These panels and walls are described in an earlier invention by the present inventor in U.S. Pat. No. 7,073,306 by Hagaman (2006). The building panels and walls have an inner insulator core and two substantially parallel surface materials which are connected together by connector ties. There is a need for structurally sturdy, energy efficient buildings that use less resources and are affordable. The use of building panels reduces construction cost and highly insulated panels save energy and resources over the life of the structure. The present invention relates to improvements in the manufacturing of these building panels and walls, so that the manufacture of these panels and walls will be more efficient and economical.

Included in the present invention are mechanisms and manufacturing machines which produce building panels in a continuous manner. This continuous manufacturing machinery is economical to build, economical to use, and energy efficient in its operation. Other improvements of the present invention are the manufacturing ability to readily make building panels of different thicknesses, widths and heights, quickly insert and attach connecting ties, and improve quality of the building panels.

3. Objects and Advantages

I have invented methods of and apparatus for manufacturing building panels. My invention is applicable to a number of building methods and materials. These manufacturing methods produce high quality building panels and walls that offer high insulation, are non toxic, save material resources, and save energy. The present invention improvements in the manufacturing of these building panels and walls will make these building panels more affordable.

Accordingly, several objects and advantages of the invention are:

To provide a manufacturing method to produce an energy efficient building panel or wall.

To provide a manufacturing method that produces building panels in a continuous manner to reduce manufacturing expense.

To provide a manufacturing method that produces building panels in a energy efficient way.

To provide a manufacturing method to produce a low cost building panel or wall.

To provide a manufacturing method to produce a non-toxic building panel or wall.

To provide a manufacturing method that produces a building panel or wall efficiently and quickly.

Further objects and advantages will become apparent from consideration of the ensuing description and drawing.

SUMMARY OF THE INVENTION

The present invention relates to the manufacture of building panels and walls.

DRAWING

Figures

The accompanying drawings, which are incorporated into and from a part of the specification, illustrate several embodiments of the present invention and together with the description, serve to explain the principles of the invention. The drawing are only for the purpose of illustrating a few embodiments of the invention and are not to be construed as limiting the invention.

In the following detailed description, reference will be made to the attached drawings, in which.

FIGS. 15 A, B, C and D illustrate a lever crimping method.

FIGS. 16 A, B and C illustrate a lever and push bar wire crimping method.

Figure 17:
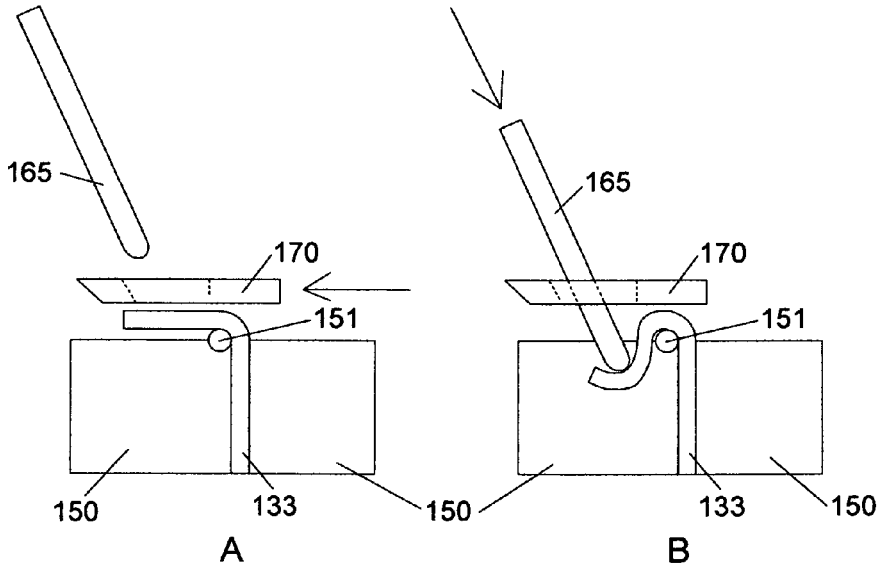

FIGS. 17 A and B illustrate a wire bender and push bar crimping method.

Figure 18:
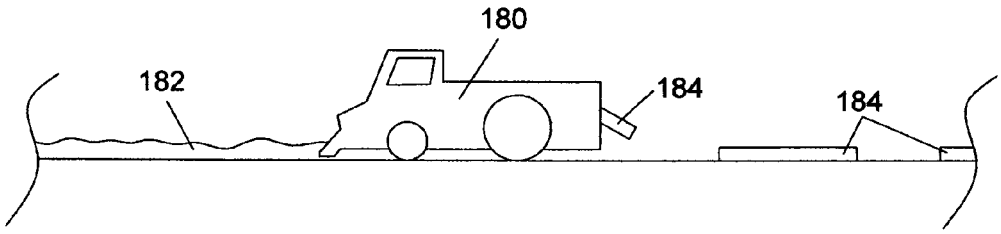

FIG. 18 depicts a mobile version of the present invention.

Figure 19:
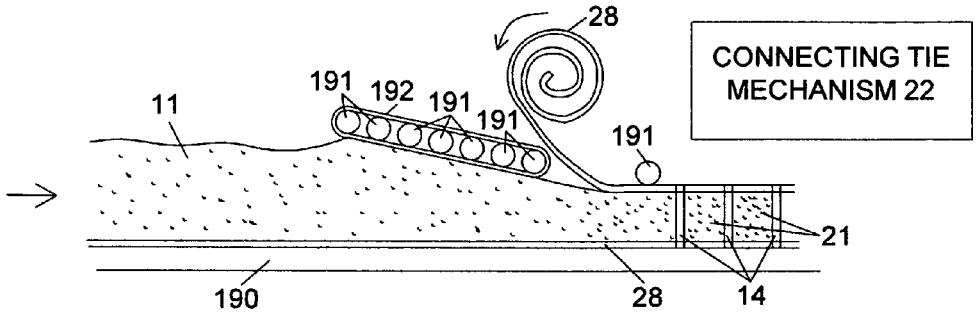

FIG. 19 is a cross sectional view of a roller press method.

Figure 20:
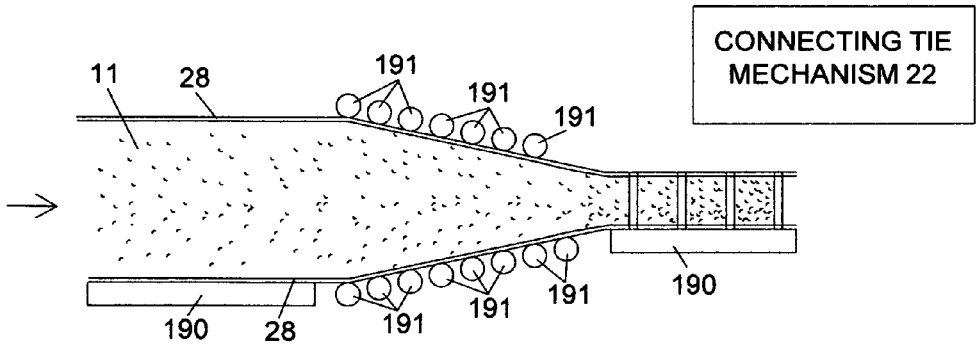

FIG. 20 is a cross sectional view of a roller press with rollers on top and bottom.

DRAWING

Reference Numerals

10 manufacturing method
11 inner core material
12 first facing material
13 second facing material
14 connecting tie
15 machine
16 building panels and wall sections
21 compressed inner core material
22 connecting tie mechanism

23 compressing roller belt
24 alignment traction nubs
25 panel surfacing synchronizing mechanism
26 conveyor belt
27 electrical chase
28 panel surfacing
31 series of rollers
36 roller table
38 panel thickness adjustment device
42 panel perimeter frame
52 pressure plate
54 base plate
62 pressure plate
64 forms
66 compression chamber
71 two wire tie
73 one wire tie
75 looped over mesh
76 mesh wire
100 clasping tie
110 frame support
111 main driver frame support and lower wire clamps
112 tie wire channel driver
113 tie wire channel base with upper wire clamps
114 piercing tie wire channel
115 frame lower crimping support and channel guides
116 lower crimping mechanism and wire cutter
117 upper crimping mechanism
118 panel passage
123 wire guide supports
124 wire spools
131 prong housing
132 support
133 wire
134 wire clamp prong
135 prong actuator
136 bolt
137 wire channel tip
138 support
139 support
146 tie wire channel rotating mechanism
144 rotating tie wire channel
148 tie wire channel cleaner
150 panel
151 mesh wire
152 lever
153 lever pivot
162 lever
163 mesh wire clasping arm
164 lever pivot
165 push bar
170 wire bender plate
180 farm field panel machine
182 agriculture materials
184 building panels.
190 base
191 roller
192 roller belt

DETAILED DESCRIPTION OF THE INVENTION

The panel manufacturing methods and mechanisms of this invention relate to systems for producing building panels of various types that may satisfactorily be practiced to erect residential, commercial, or even industrial buildings. The description of the methods of fabrication and use of the present invention will enable one skilled in the art to adapt and adjust the disclosed methods and mechanisms to accomplish the fabrication of any number of mechanisms to produce building panels. The invention is widely applicable and some of the descriptions tend to be general because there are so many ways to make and use the invention.

Figure 1:
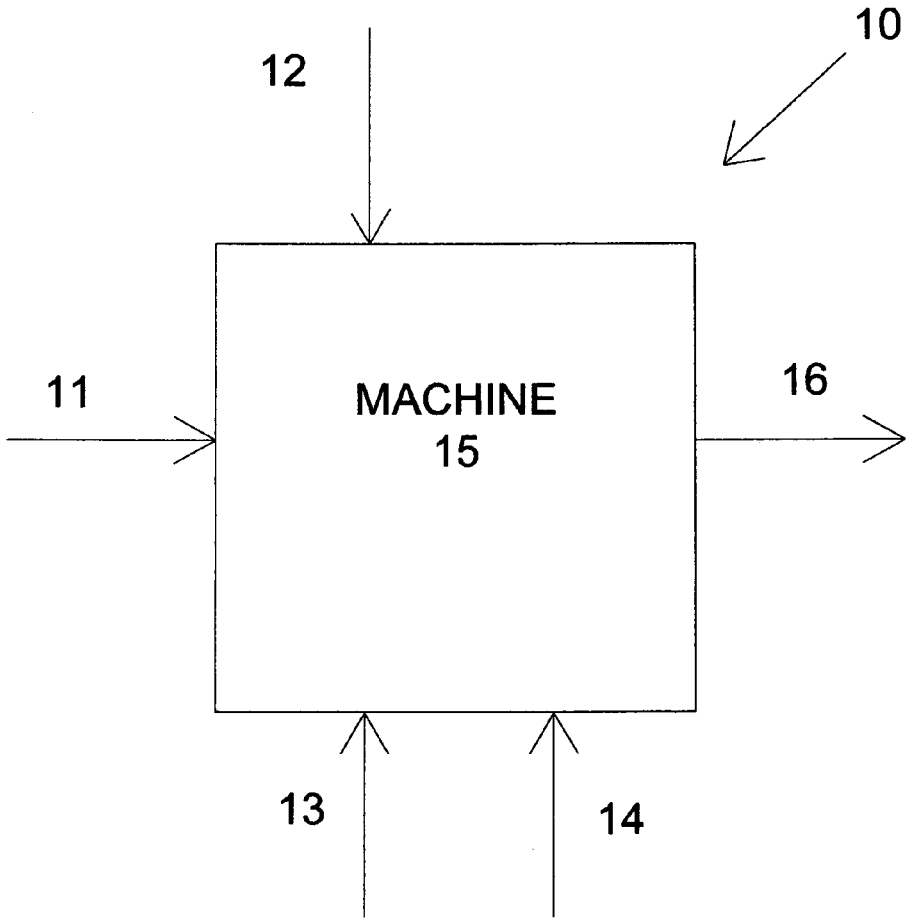
FIG. 1 is a block diagram of a manufacturing method.

FIG. 1 shows a block diagram of manufacturing method 10 which makes building panels and wall sections 16. The building panels and wall sections consist of inner core material 11 sandwiched between and substantially parallel to first facing material 12 and a second facing material 13 connected together by connector ties 14. Machine 15 connects inner core material 11, first facing material 12, and second facing material 13 together by placing connecting ties 14 through the inner core material 11 and attaching connecting ties 14 to first facing material 12 and second facing material 13. Machine 15 also advances inner core material 11.

Inner core material 11 can be any suitable material including fiber, straw, rice straw, agricultural biomass, wood chips and shaving, organic materials, paper, cardboard, bagasse, shredded plastic, and shredded paper. A facing material in the present invention can be any suitable material including wire mesh, plastic, jute, burlap, plywood, oriented strand board, and cement board. Connecting ties in the present invention can be any suitable material or design including wire, jute, strapping, hooks, cord, staples, and clasping ties. Metal welding can also be used to attach metal connecting ties to a metal mesh facing material.

A preferred embodiment of machine 15 compresses inner core material 11 when compression is desired. FIGS. 2, 3, 5, 6A, and 6B show several preferred compression mechanisms. Another preferred embodiment of machine 15 has mechanisms which combine inner core material 11, first facing material 12, and second facing material 13 so that inner core material 11 is sandwiched between and substantially parallel to first facing material 12 and second facing material 13. FIGS. 11, 12, 13, 14, 15, 16, and 17 show several preferred mechanisms to attach inner core material 11, first facing material 12 and second facing material 13 together with connecting ties.

Figure 2:
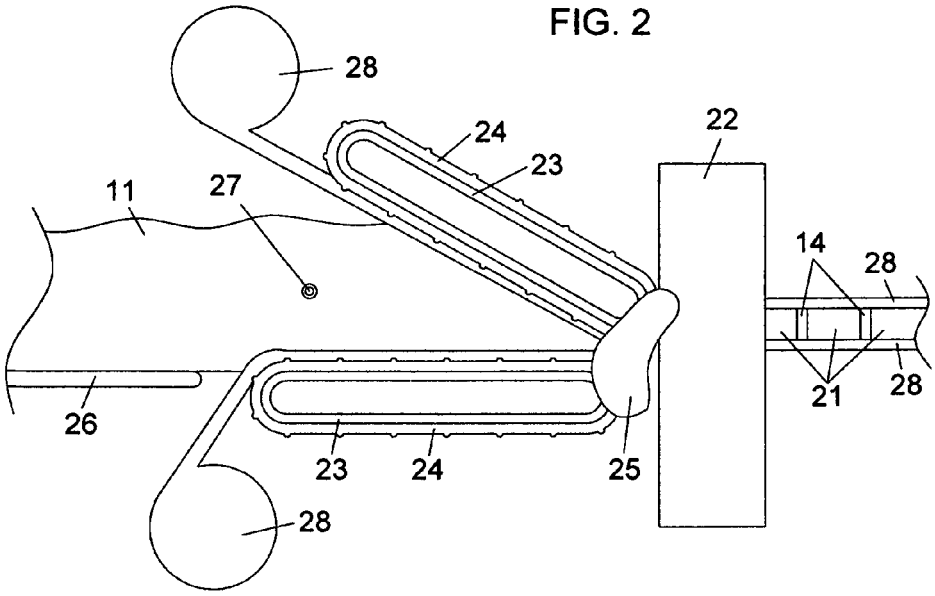
FIG. 2 is a cross sectional view of a manufacturing machine.

FIG. 2 shows a cross sectional view of a preferred building panel and wall section manufacturing machine which uses a compressing belt arranged in a slanting configuration so as to compress a straw panel. FIG. 2 shows conveyor belt 26 and inner core material 11 on the center left, panel surfacing 28 above inner core material 11 and another panel surfacing 28 below inner core material 11, electrical chase 27 is shown inserted into inner core material 11, compressing roller belt 23 are above and below inner core material 11, compressed inner core material 21 is on the right side bound by connector ties 14 and panel surfacing 28, panel surfacing synchronizing mechanism 25, and connecting tie machine 22.

Above conveyor belt 26 is inner core material 11. The arrow on the left shows the direction inner core material 11 moves on the conveyor belt 26. Upper and lower panel surfacing 28 are unrolled and placed on the top and bottom of inner core material 11 as panel surfacing 28 and inner core material 11 advance through this machine. The inner core material 11 and panel surfacing 28 are compressed by the compressing roller belt 23. Panel surfacing 28 can be any suitable surface material including mesh, screen, jute mesh. Compressing roller belt 28 may be used as a propelling mechanism though any suitable propelling mechanism can be used to move the inner core material 11 and panel surfacing 28 through the compressing roller belt 23. Compressing roller belt 23 may have mechanisms like alignment traction nubs 24 which align panel surfacing 28 on the compressing roller belt 23, other suitable alignment methods may be used. Panel surfacing synchronizing mechanism 25 is used to synchronize the upper and lower panel surfacing 28 by synchronizing compression roller belt 23. Panel surfacing synchronizing mechanism 25 can also be designed to synchronize the panel surfacing 28 directly without engaging compression roller belt 23. Panel surfacing 28 can also be placed on inner core material 11 after inner core material 11 has gone through compression (not illustrated) and aligned and synchronize also after compression takes place. FIG. 2 shows a electrical chase 27 in inner core material 11. Placing the electrical chase 27 in the inner core material 11 before compression makes it easier to get an electrical chase in the panel and reduces labor and costs associated with putting electrical chases in.

As the inner core material passes between compressing roller belt 23, inner core material 11 is compressed and its thickness is reduced. The turning of the roller belt allows inner core material 11 to be compressed without inner core material 11 tending to be pushed backwards. Any suitable compressing roller belt can be used and rollers without belts can also be used to compress inner core material 11. A single roller of suitable size can also be used to compress inner core material 11. A height adjustment device that adjusts the distance between the upper and lower compressing mechanisms can be included to allow for various panel thicknesses.

Compressed inner core material 21 and panel surfacing 28 exit compressing roller belt 23 on the right hand side of FIG. 2. Then connecting tie machine 22 attaches the two panel surfacing 28 together with a connecting tie 14 which passes through compressed inner core material 21. Connecting tie mechanism 22 can be any suitable connecting tie mechanism, and connecting tie 14 can be any suitable connecting tie. For instance the connecting tie mechanism illustrated in FIGS. 11 and 12, and the connecting tie illustrated in FIGS. 7, 8, 9, and 10.

Figure 3:
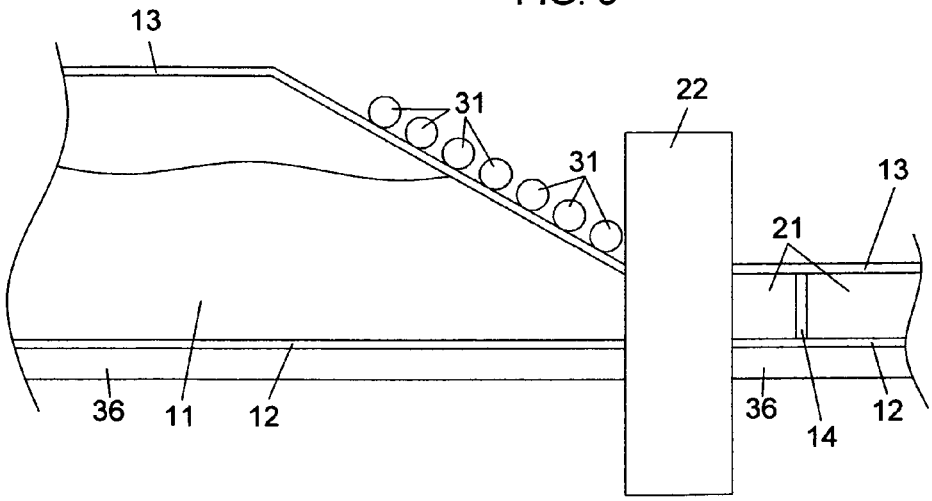
FIG. 3 is a cross sectional view of a panel press method.

FIG. 3 is a cross sectional view of a preferred panel press method which uses a series of rollers 31 in a stepping configuration so as to compress inner core material 11. FIG. 3 shows a first facing material 12 above roller table 36, second facing material 13 above inner core material 11, step rollers 31, connector tie 14, connecting tie mechanism 22, and panel thickness adjustment device 38. The arrow on the left side shows the direction inner core material 11, first facing material 12, and second facing material 13 move relative to the rollers so as to be compressed. Any suitable propelling mechanism can be used to move the inner core material and facing materials along. Roller table 36 serves as a base that restricts movement, so that when inner core material 11 passes between step rollers 31 and roller table 36, inner core material 11 is compressed and its thickness is reduced. When the inner core material and facing materials exit the roller press towards the right side of FIG. 3, connecting tie mechanism 22 binds them together. Connecting tie mechanism 22 can be any suitable connecting tie mechanism. For instance, if first facing material 12 and second facing material 13 are plywood, the connecting tie mechanism could connect the plywood facing and inner core material with ribbits, screws, staples, fasteners, and any other suitable connecting tie. If the facing materials are mesh, and/or a combination of a mesh and a plywood, other type fasteners and possibly a different connecting tie mechanism could be needed.

A single roller of suitable size can also be used. Panel thickness adjustment device 38 adjusts to allow for various panel thicknesses. Panel perimeter frames can be filled with inner core material and go through the panel press or these frames can be attached to the panels afterwards. Window and door bucks can also go through a roller press. Roller presses are versatile in this way. This allows custom panels to be manufactured more easily which reduces the custom panel cost and custom panels require less labor as compared to modifying panels on site, and so save construction time.

Figure 4:
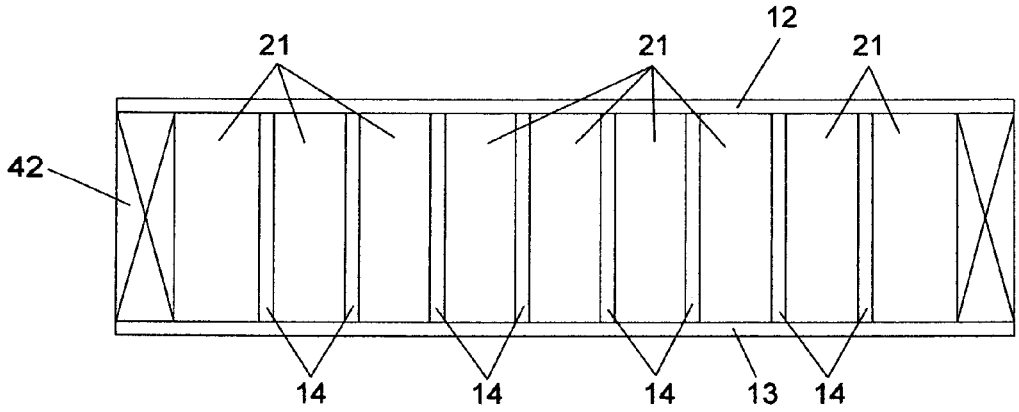
FIG. 4 is a cross sectional view of a panel with mesh and perimeter frame.

FIG. 4 is a cross sectional view of a building panel with panel perimeter frame 42, connecting ties 14, first facing material 12, second facing material 13, and compressed inner core material 21.

Figure 5:
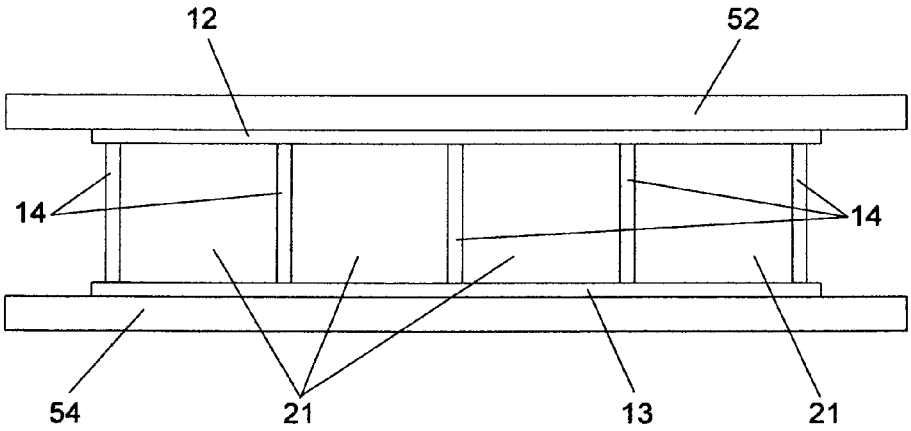
FIG. 5 is a cross sectional view of a surface compression method.

FIG. 5 is a cross sectional view of a preferred surface compression method which illustrates inner core material 11 compressed between pressure plate 52 and base plate 54. The movement of pressure plate 52 is shown by an arrow. Connecting ties 14 can attach inner core material 11, first facing material 12, and second facing material 13 together while still in the press, or connecting tie 14 can be attached as inner core material 11 and first facing material 12 and second facing material 13 are pushed out the side of the press (not illustrated). Another preferred way is to compress inner core material 11 and then as inner core material 11 is pushed out the side of the press, add first facing material 12, second facing material 13, and connect connecting tie 14 (also not illustrated).

Figure 6A:
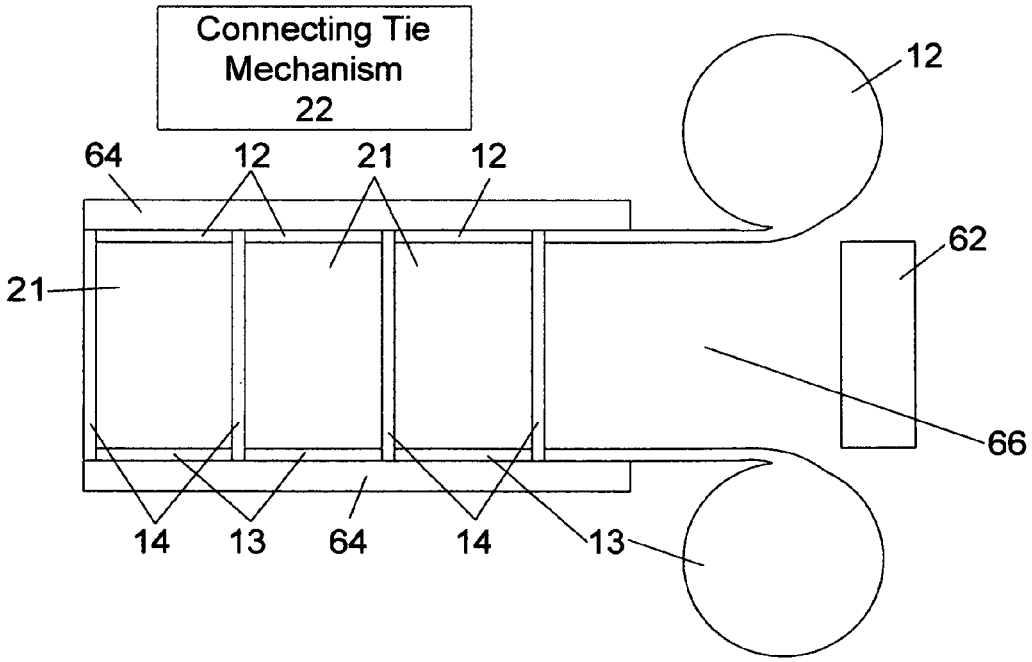
FIGS. 6A and 6B are cross sectional views of a panel edge compression method.
Figure 6B:
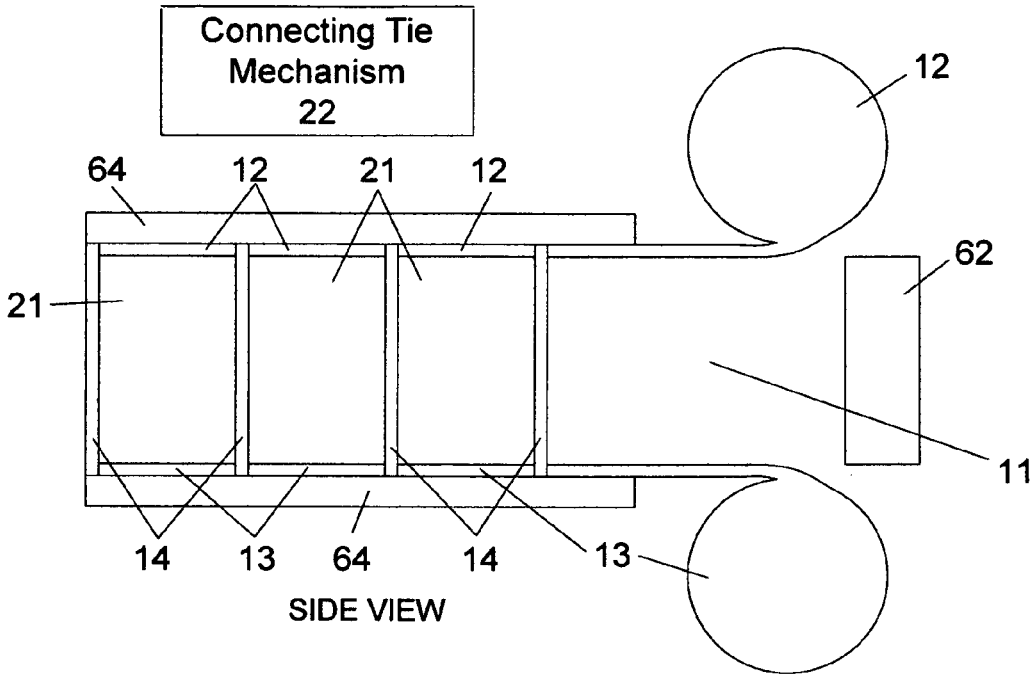

FIGS. 6A and 6B are cross sectional views of a preferred compression method. FIG. 6A includes pressure plate 62, forms 64, connecting tie mechanism 22, first facing material 12, second facing material 13, compressed inner core material 21, connecting tie 14, and compression chamber 66. In FIG. 6B inner core material 11 is loaded into the compression chamber area and pressure plate 62 moves in the direction of the arrow (located on the right) to compress the inner core material 11. After pressure plate 62 compresses inner core material 11 between forms 64 and the previously compressed inner core material 21, connecting tie mechanism 22 attaches connecting tie 14 to first facing material 12 and second facing material 13. Pressure plate 62 is then retracted and the bound, compressed part of this panel is advanced to make room in compression chamber 66. Then the process of loading inner core material 11, compressing, tying, and advancing the materials is repeated until the panel is completed. First facing material 12 and second facing material 13 are shown coiled, but they can also be a substantially flat and/or rigid material like cement board and plywood. Connecting tie mechanism 22 can also mount on pressure plate 62.

Figure 6C:
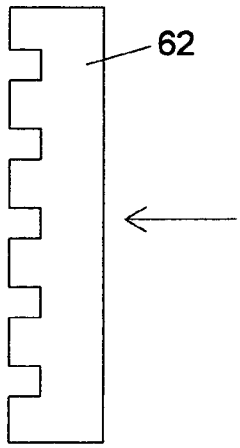
FIG. 6C is a top view of a pressure plate.

FIG. 6C shows a top view of a preferred type of pressure plate 62. On the left side of this preferred type of pressure plate 62 are a number of passages which allow easier passage of ties when binding compressed straw along the pressure plate. This reduces the amount of force required to insert a tie through the straw and can also assist guiding a tie through to a designated area on the opposing side.

Figure 7:
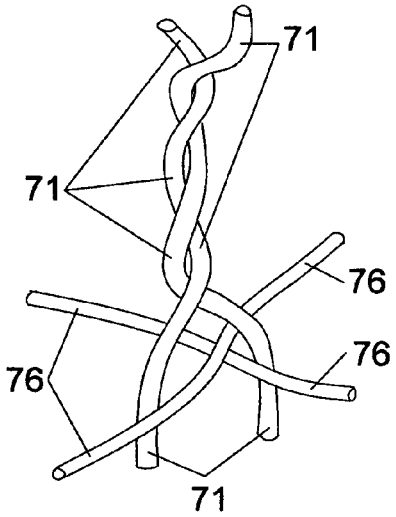
FIG. 7 shows a two wire tie wrapping method.
Figure 8:
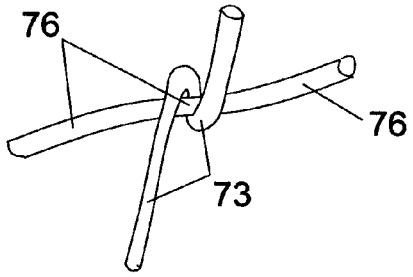
FIG. 8 shows a one wire wrapping method.
Figure 9:
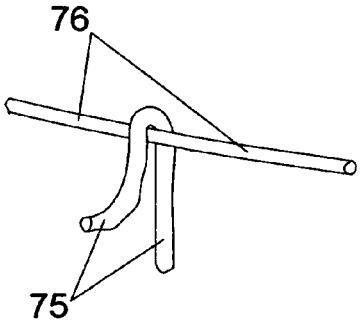
FIG. 9 shows a single wire bent over attaching method.
Figure 10:
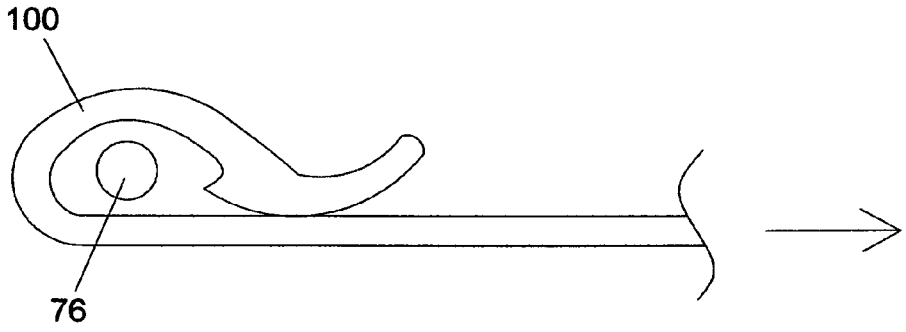
FIG. 10 shows a slip-over tie end.

FIGS. 7, 8, 9, and 10 are several preferred connecting tie 14 attaching methods. FIG. 7 depicts two wire tie wrapping 71 method, and shows two wire tie 71 attached on the intersection of mesh wire 76. FIG. 8 shows a one wire wrapping tie 73 method. FIG. 9 shows a single wire looped over mesh 75 attaching method. FIG. 10 is a tie end which can be slipped over a mesh wire and will then latch on to the mesh wire, and will not easily back out. The arrow on the right denotes the direction clasping tie 100 is moved so it slips over mesh wire 76. Once inside clasping tie 100, mesh wire 76 can not so easily go out the way it went in because of the slightly curved barb which will detain it there at least until clasping tie 100 is bent so far as the barb can no longer contain it. If force is applied in the opposite direction clasping tie 100 again has to be bent by that force so far as to no longer be able to contain mesh wire 76. When a plaster is applied on a panel surface unhooking a tie end is much harder.

Figure 11:
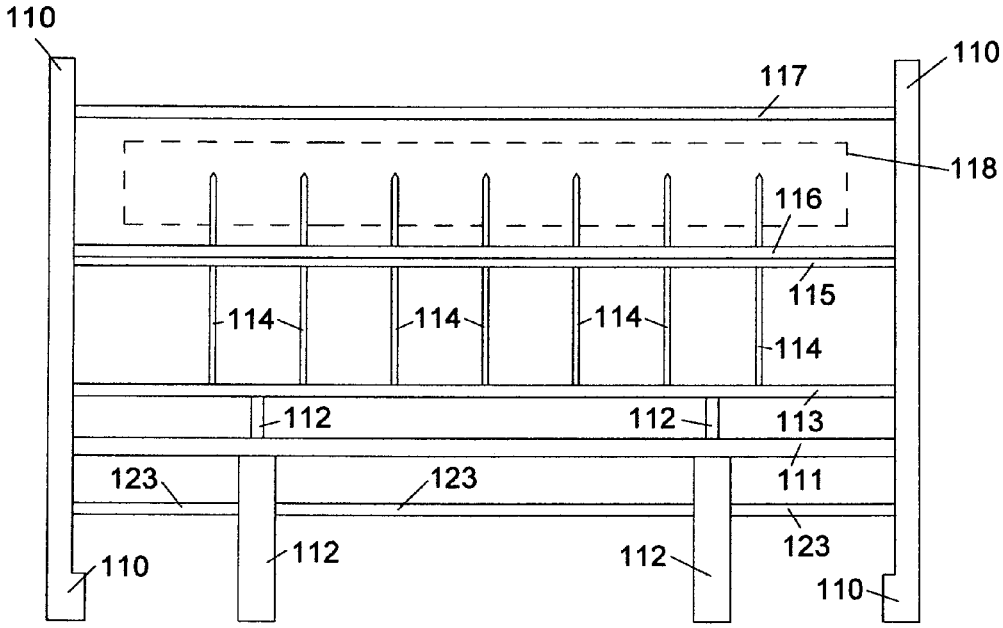
FIG. 11 is a front view of a mechanism that threads multiple wire ties through a panel and then attaches them.
Figure 12:
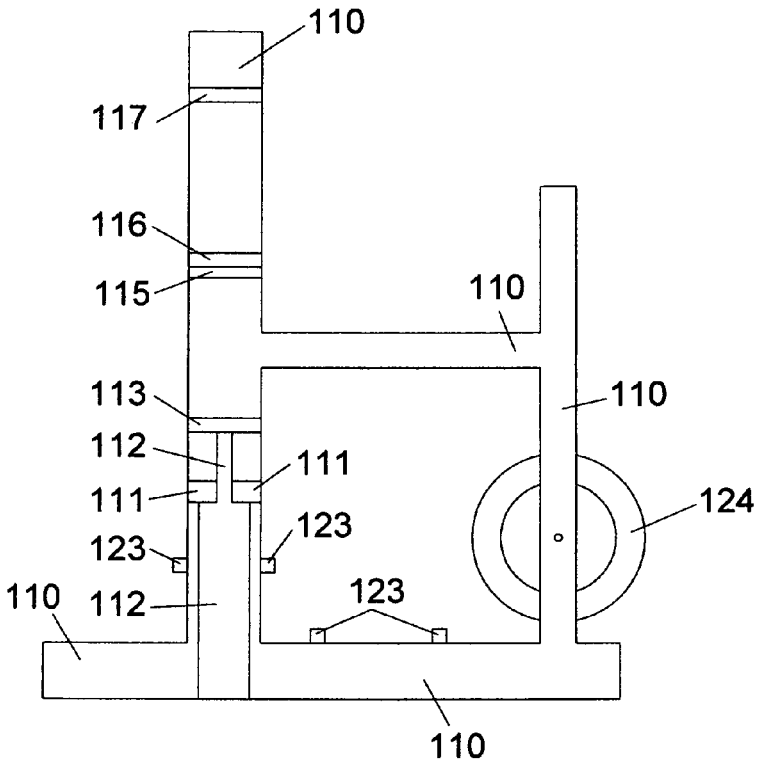
FIG. 12 is a side view of a mechanism that threads multiple wire ties through a panel and then attaches them.

FIGS. 11 and 12 show a series of tie apparatus or mechanisms arranged in a row. Any suitable arrangement of tie mechanisms can be used, including: a single tie mechanism in which a panel is moved around so as to position the panel for the tie operation, a tie mechanism that is moved around a panel to position the tie operation, and an arrangement of tie mechanisms that can complete all the panel ties that an entire panel requires in one operation. Other configurations of this tying mechanism and its components can be built. For instance piercing tie wire channels 114 can insert the tie wire from the top.

The panel's materials, inner core material 11, first facing material 12, and second facing material 13, pass through panel passage 118. Panel passage 118 is drawn as a broken line. Tie wire channel drivers 112 drive piercing tie wire channels 114 through the panel materials in panel passage 118 by raising tie wire channel base with upper wire clamps 113. Tie wire channel drivers 112 can be any suitable method and device such as pneumatic and hydraulic machinery. The upper wire clamps located on tie wire base with upper wire clamps 113 hold the wire in the wire channel as it goes up which also pulls wire from wire spools 124. The upper wire clamps release on the tie wire channel driver 112 downstroke and the lower wire clamps located on main driver frame support and lower wire clamps 111 engage. The lower wire clamps hold the tie wire so that when the piercing tie wire channels 114 descend the tie wires remain in inner core material 11. A portion of wire extending out the surfaces of the panel is left. This is used for attaching to the panel surface meshes. The wire clamps can be any suitable method, material, and design capable of detaining the tie wires. For instance, a pneumatic cylinder that actuates a metal push rod and/or cam locks. Piercing tie wire channels 114 can also be any suitable method, material, and design with which a tie can be inserted into a panel with. For instance, tubes, open channels, rotating tubes and rotating channels.

After the tie wires are deposited in the panel materials, wire cutters located on lower crimping mechanism and wire cutters 116 cut the wires and then the wire crimpers located on lower crimping mechanism and wire cutters 116 and upper crimping mechanism 117 attach the tie wire ends to the panel surface meshes. Wire crimpers can be any suitable method capable of attaching the tie wires. Wire cutters can be any suitable method for cutting the wires.

Figure 13:
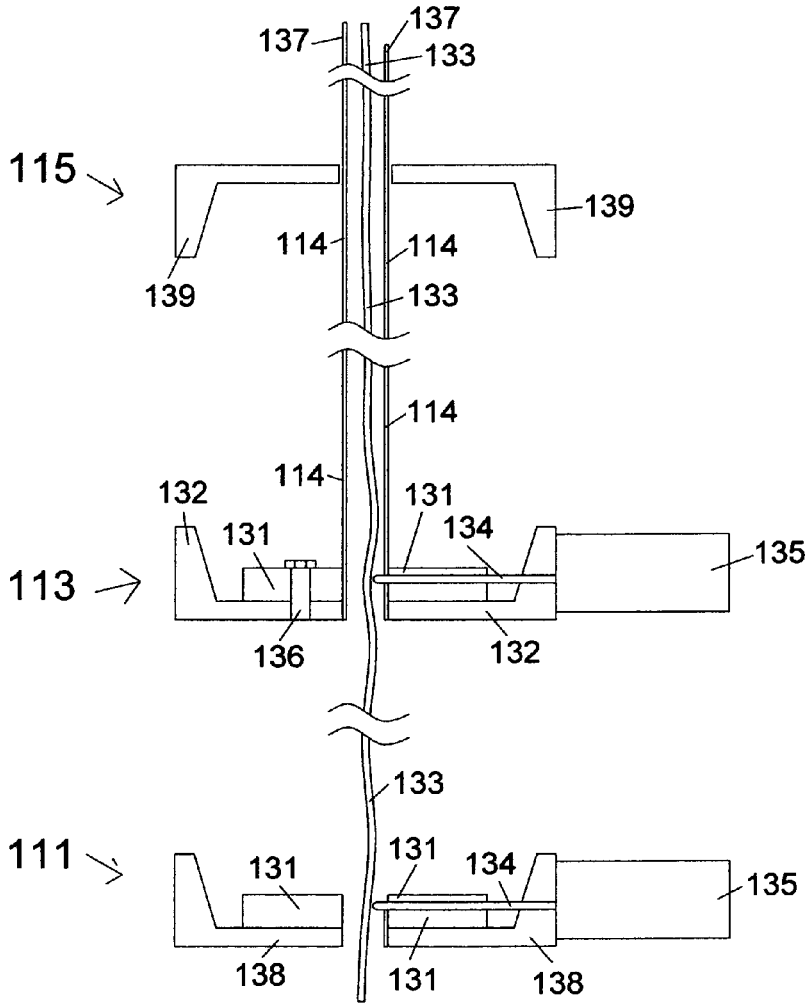
FIG. 13 is a cross sectional view which shows several details of the FIGS. 11 and 12 above.

FIG. 13 is a cross sectional side view which shows several details of preferred mechanisms of FIGS. 11 and 12. In the center area of FIG. 13 is tie wire channel with upper wire clamps 113. Located on support 132 are piercing tie wire channel 114, channel base/prong housing 131, wire clamp prong 134, and prong actuator 135. Also shown is wire 133 which is guided through piercing tie wire channel 114. Wire clamp prong 134 exerts pressure on wire 133 when prong actuator 135 pushes on it. This holds wire 133 in place during the upward motion of piercing tie wire channel 114 as it is driven through the panel materials. Towards the lower area of FIG. 13 are main driver frame support and lower wire clamps 111 which clamps wire 133 during the piercing tie wire channels 114 downward stroke so that the upper portion of wire 133 will remain in the panel. Of course, the upper wire clamps must release wire 133 first. The upper portion of FIG. 13 depicts frame lower crimping support and channel guides 115 which shows support 138 with a passage in it used as a guide for piercing tie wire channels 114. Piercing tie wire channel 114 has a pointed wire channel tip 137 to facilitate easier piercing. After wire 133 has been set in a panel, the portions of wire 133 extending above and below the panel can be attached to a mesh.

Figure 14:
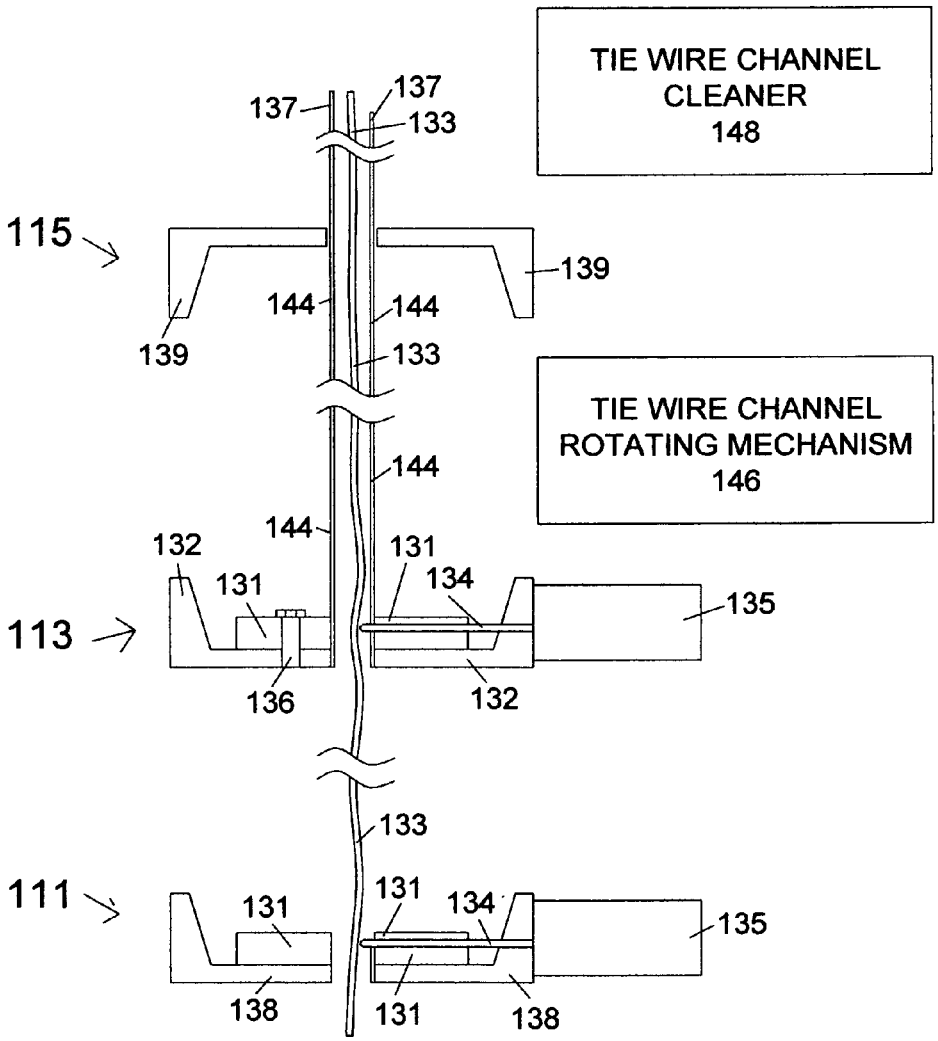
FIG. 14 shows a rotating tie wire channel.

FIG. 14 shows a rotating tie wire channel 144, tie wire channel rotating mechanism 146, and tie wire channel cleaner 148. Tie wire channel rotating mechanism 146 rotates the rotating tie wire channel 144. Rotating the tie wire channel facilitates the passage of the tie wire channel through the inner core material. Wire channel tip 137 can be any suitable type tip such as saw toothed and spiral tipped. Tie wire channels can get clogged. FIG. 14 shows a tie wire channel cleaner 148. Any suitable tie wire cleaning device can be used, such as compressed air devices.

A preferred crimping mechanism method is shown in FIGS. 15 A, B, C, and D. These figures illustrate lever 152 folding wire 133 over mesh wire 151, which is located on panel 150. FIG. 15A shows the relative starting positions of panel 150, mesh wire 151, wire 133, and lever 152. FIGS. 15 B, C, and D show lever 152 rotating on lever pivot 153 and folding wire 133 over mesh wire 151 so as to attach wire 133 to mesh wire 151. The force required to rotate lever 152 and lever pivot 153 can be supplied by any suitable device and method. Lever 152 has a curved surface which stops inner core material from restricting lever 152 when exiting panel 150.

FIGS. 16 A, B, and C illustrate a preferred wire crimping method which has a mesh wire clasping arm 163, that holds mesh wire 151 in place when wire 133 is being folded over it by lever 162. A mesh wire clasping arm can also be used with the crimping mechanism shown in FIGS. 15 A, B, C and D. FIGS. 16 A, B and C also illustrate push bar 165 being used to push a portion of wire 133 down into panel 150 so as to bend wire 133 around mesh wire 151. The end of wire 133 can be left flared out to help stop wire 133 from loosening its grip around mesh wire 151. This flared end restricts wire 133 movement even better when a plaster is applied.

FIG. 16A shows elements of this tie wire crimping method at the beginning positions. Wire 133 extends above panel 150 with mesh wire 151 to its right. To the left of wire 133 is lever 162 which rotates on lever pivot 164 and has mesh wire clasping arm 163 attached to it. FIG. 16B shows lever 162 after it has rotated on lever pivot 164 to a substantially horizontal position and has bent the upper end of wire 133 over mesh wire 151. FIG. 16B also shows mesh wire clasping arm 163 rotated so as to hold mesh wire 151 steady while wire 133 is being bent over mesh wire 151 by lever 162. FIG. 16C shows push bar 165 extended through a opening in lever 162 and down into panel 150, driving wire 133 down into panel 150 and around mesh wire 151. Mesh wire clasping arm 163 has been removed from FIG. 16C for clarity.

FIGS. 17 A and B illustrate another preferred method for attaching tie wire to surface mesh. FIG. 17A shows the top portion of wire 133 bent over mesh wire 151 to a horizontal position by wire bender plate 170. The arrow denotes the direction that wire bender plate 170 was moved to bend wire 133. FIG. 17B shows the next step in attaching wire 133 to mesh wire 151. Push bar 165 is driven down through an opening in wire bender plate 170 and into panel 150 so as to bend wire 133 around mesh wire 151.

FIG. 18 depicts farm field panel machine 180 which is a mobile version of the present invention that picks up agriculture materials 182 from the field for use as an inner core material, and then produces building panels 184.

FIG. 19 is a cross sectional view of a preferred panel press method which uses a series of rollers in a stepping configuration so as to compress a panel. FIG. 19 shows a panel surfacing 28 above base 190 plate, another panel surfacing 28 partly coiled higher up, inner core material 11, compressed inner core material 21, rollers 191, roller belt 192, connecting tie 14, and a tie mechanism denoted by a rectangle labeled connecting tie mechanism 22. The arrow on the left side shows the direction the inner core material 11 and panel surfacing 28 move relative to the rollers so as to be compressed. Panel surfacing 28 can be any suitable surface material including mesh and plywood. Any suitable propelling mechanism can be used to move the inner core material and meshes through the rollers. As the inner core material passes between the roller and base plate the inner core material thickness is reduced. The turning of the rollers and roller belt allow the inner core material to be compressed without the inner core material tending to be pushed backwards. Roller belt 192 isn't necessary for the roller press to function and is shown here as an optional feature. The upper panel surfacing 28 is shown being deposited on inner core material 11 after inner core material 11 has gone through the roller press. The upper panel surfacing 28 can also be placed on inner core material 11 before inner core material 11 goes through the roller press. When the compressed inner core material 21 and panel surfacing 28 exit the roller press to the right side of FIG. 19, the tie mechanism binds them together. This tie mechanism can be any suitable tie mechanism. For instance the tie mechanism illustrated in FIGS. 11 and 12 above. Though the arrow shows the inner core material being pushed through the roller press it can also be pulled through the roller press on top of lower panel surfacing 28 or between a lower and upper panel surfacing 28. A roller press like this can also be pushed or pulled over a stationary inner core material 11 to compress it. A single roller of suitable size can also be used. The roller press can be adjustable to allow for various panel thicknesses.

FIG. 20 is a preferred method similar to FIG. 19 with the exception of a few changes. FIG. 20 has rollers above and below inner core material 11 and panel surfaces 28 so as to compress inner core material 11 from top and bottom. Another difference is the panel surfacing 28 is shown on inner core material 11 before going through rollers 191, though panel surfacing 28 can also be deposited on inner core material 11 after inner core material 11 goes through roller 191. No roller belts are shown in FIG. 20 though they can be used if desired. Single rollers on top and bottom can also be used.

CONCLUSIONS, RAMIFICATIONS AND SCOPE OF THE INVENTION

It should be apparent to the reader that the present invention reduces manufacturing time which reduces costs.

The current invention helps make energy efficient housing affordable.

One of the characteristics of the present invention is its flexibility. It can accommodate various materials, shapes, sizes, and designs, and so the present invention's ramifications are widespread in scope.

The above description contains many specificities. These should not be construed as limitations on the scope of the invention but rather as exemplifications of one preferred embodiment thereof. Many other variations are possible, for instance:

Materials can be substituted for all elements of mechanisms and panels to suit.

Manufacturing methods can be designed to modify the panel structural characteristics such as diagonal ties.

Mechanisms to build curved panels can be built.

Tie mechanisms can be transportable and used on a construction site.

Operations and techniques in this method can be mechanized to any degree, limited only by the ability and skill one has to design and build such machines. It is expected with time and incentive this invention will be further automated.

Thus the scope of the present invention should be determined by the appended claims and their legal equivalents, rather then by the examples given.

What is claimed is:

1. A building panel and wall manufacturing apparatus that attaches an inner core material and two surfacing materials together with connecting ties, comprising:

A. a mechanism that places the inner core material between a substantially parallel first surfacing material and a substantially parallel second surfacing material, B. a first roller, C. a second roller positioned in a stepped configuration to said first roller, D. a belt wrapped around said first roller and said second roller that compresses said inner core material, E. a mechanism that places connecting ties into said inner core material, F. a mechanism that attaches a first end of said connecting ties to said first surfacing material, and G. a mechanism that attaches a second end of said connecting ties to said second surfacing material, whereby said inner core material is substantially bound between said first surfacing material and said second surfacing material.

2. The apparatus of claim 1 further including a panel thickness adjustment device that allows for various panel thicknesses.

3. The apparatus of claim 1 wherein said connecting tie is looped around a mesh wire at least once.

4. The apparatus of claim 1 wherein said tie attaching device is a wire bender and push bar type.

5. The apparatus of claim 1 further including additional rollers positioned in a stepped configuration.

6. The apparatus of claim 1 further comprising a wire clamp device to regulate the movement of said connecting tie.

7. The apparatus of claim 1 wherein said inner core material compression takes place before said inner core material is placed between said first surfacing material and said second surfacing material.

8. A manufacturing apparatus for connecting two panel surface meshes with an insulator core material between them together, comprising:

A. means to compress a insulator material,

B. means to place a first mesh on a first face of said insulator material substantially parallel to said insulator material, C. means to place a second mesh on a second face of said insulator material substantially parallel to said insulator material, D. a rotating channel to place a connecting tie into said insulator material, E. means to attach a first end of said connecting tie to said first mesh, and F. means to attach a second end of said connecting tie to said second mesh, so as to substantially bind the insulator material between said first mesh and said second mesh and hold said insulator material in compression.

9. The apparatus of claim 8 wherein said connecting tie is looped around a mesh wire at least once.

10. The apparatus of claim 8 wherein said tie attaching device is a wire bender and push bar type.

11. The apparatus of claim 8 further comprising a wire clamp device to regulate the movement of said connecting tie.

12. The apparatus of claim 8 further comprising a wire cutter device to cut said connecting tie to length.

13. The apparatus of claim 8 further including a panel thickness adjustment device that allows for various panel thicknesses.

14. The apparatus of claim 8 wherein said rotating channel to place a connecting tie into said insulator material, further includes saw teeth on the rotating tie wire channel.

15. A building panel and wall manufacturing apparatus that attaches an inner core material and two surfacing materials together with connecting ties, comprising:

A. a mechanism that places the inner core material between a substantially parallel first mesh surfacing material and a substantially parallel second mesh surfacing material, B. a mechanism that substantially synchronizes the strands of said first mesh surfacing material and said second mesh surfacing material, to facilitate the placement and connection of connecting ties to said first mesh surfacing material and said second mesh surfacing material, C. a mechanism that places said connecting ties into said inner core material, D. a mechanism that attaches a first end of said connecting ties to said first mesh surfacing material, and E. a mechanism that attaches a second end of said connecting ties to said second mesh surfacing material, whereby said inner core material is substantially bound between said first mesh surfacing material and said second mesh surfacing material.

16. The manufacturing apparatus of claim 15 further including means to compress said insulator material.

17. The apparatus of claim 15 wherein said means to compress said inner core material is a pressure plate.

18. The apparatus of claim 15 wherein said inner core material compression takes place before said inner core material is placed between said first surfacing material and said second surfacing material.

19. The apparatus of claim 15 wherein said connecting tie is looped around a mesh wire at least once.

20. The apparatus of claim 15 further including a panel thickness adjustment device that allows for various panel thicknesses.

* * * * *